United States Patent [19]

Soda

[11] Patent Number: 5,000,454

[45] Date of Patent: Mar. 19, 1991

[54] GOLF CLUB HEAD

[75] Inventor: Takeo Soda, Iwatsuki, Japan

[73] Assignee: Maruman Golf Kabushiki Kaisha, Tokyo, Japan

[21] Appl. No.: 400,910

[22] Filed: Aug. 30, 1989

[30] Foreign Application Priority Data

Aug. 31, 1988 [JP] Japan ..... 63-214947

[51] Int. Cl.[5] ..... A63B 53/04

[52] U.S. Cl. ..... 273/167 H; 273/169; 273/173; 273/167 A

[58] Field of Search ..... 273/167-175, 273/77 A, DIG. 23

[56] References Cited

U.S. PATENT DOCUMENTS

| | | | |
|---|---|---|---|
| 1,444,409 | 2/1923 | Willmott | 273/169 |
| 1,525,352 | 2/1925 | Aitken | 273/173 X |
| 1,546,612 | 7/1925 | Barnes | 273/173 X |
| 3,794,328 | 2/1974 | Gordon | 273/167 E |
| 4,214,754 | 7/1980 | Zebelean | 273/167 H |
| 4,313,607 | 2/1982 | Thompson | 273/167 H |
| 4,511,145 | 4/1985 | Schmidt | 273/167 H |
| 4,535,990 | 8/1985 | Yamada | 273/173 |
| 4,614,627 | 9/1986 | Curtis et al. | 273/167 H X |
| 4,681,321 | 7/1987 | Chen et al. | 273/167 H |
| 4,732,389 | 3/1988 | Kobayashi | 273/169 |
| 4,756,634 | 7/1988 | Thompson | 273/171 |
| 4,811,949 | 3/1989 | Kobayashi | 273/171 |

FOREIGN PATENT DOCUMENTS

| | | | |
|---|---|---|---|
| 7287 | of 1908 | United Kingdom | 273/169 |
| 320074 | 10/1929 | United Kingdom | 273/164 |
| 398643 | 9/1933 | United Kingdom | 273/169 |

*Primary Examiner*—Edward M. Coven
*Assistant Examiner*—Sebastiano Passaniti
*Attorney, Agent, or Firm*—Armstrong, Nikaido Marmelstein Kubovcik & Murray

[57] ABSTRACT

A golf club head is disclosed which comprises a body made of a fiber-reinforced plastic having a back side, a club face, a sole and a hosel. A weight member having a nearly circular configuration is located adjacent to the inner circumference of the back side and at a position lower than the vertical centerline of the club face and a reinforcing member is located adjacent to the inside of the club face.

9 Claims, 2 Drawing Sheets

GOLF CLUB HEAD

BACKGROUND OF THE INVENTION

1. Field of the Invention

The present invention relates to a golf club head and more particularly, to a golf club head which is made of a fiber-reinforced plastic.

2. Description of the Prior Art

Recently, golf club heads have been made of various materials, such as a fiber-reinforced plastic, metal or the like. This is because heads for a wood-type golf club are typically made of wood, such as persimmon, and such wood resources are becoming exhausted, an at the same time, production techniques have made remarkable progress.

A golf club head made of a fiber-reinforced plastic is generally designed to lower the center of gravity of the overall club head by using a body which is hollow inside, or which has a light-weight foamed plastic material filled therein, or by using a sole plate secured to the sole of the body and made of aluminum or brass which has a specific gravity greater than that of the fiber-reinforced plastic.

As described above, when the center of gravity of the club head is lowered by using such a sole plastic material with a large specific gravity, the weight of the club head is concentrated at a position away from the impact point which a golf ball is hit, and as a result, a rotating force is produced about the impact point to cause backspin on the ball, and this backspin results in decreasing the distance of the flight of the ball.

Furthermore, a conventional club head made of a fiber-reinforced plastic, was designed to have a thicker club face (thickness is between 7 and 12 mm) to resist the deformation of the club face upon impact with a golf ball, but inevitably the thickness of the remainder of the club head had to be thinner (the thickness is between 3 and mm). A club head having such a construction has the disadvantage that the thinner area of the remainder of the club head other than the club face is easy to deform upon impact with a golf ball and due to this deformation of the thinner area, the impact energy can not be efficiently transmitted to the golf ball, and as a result, the distance of flight of the ball is not increased. It also has the disadvantage that the sweet spot will become smaller because the weight is concentrated on the thicker club face. Furthermore, the sole plate rusts easily because it is a metal material, and a players' miss-shot ratio is high because of poor sliding of the sole plate and possible mishitting.

SUMMARY OF THE INVENTION

Accordingly, it is an object of the present invention to provide a golf club head which can control the rotation of the club head upon impact with a golf ball and resist the deformation of the club head so that a golf player can reduce mishitting and duffing, and make stable shots with increased distance of flight of the ball.

It is another object of the present invention to provide a club head including a body made of a fiber-reinforced plastic, a weight member of circular configuration provided adjacent to the inner circumference of the body, and a reinforcing member provided adjacent to the inside of the club face.

The present invention is directed to a golf club head comprising a body made of a fiber-reinforced plastic and having a back side, a club face for hitting a golf ball, a sole and a hosel. A weight member having a substantially circular configuration is provided adjacent to the inner circumference of the back side of the body and at a position lower than the vertical centerline of the club face, and a reinforcing member is provided adjacent the inside of the club face.

Furthermore, in a golf club head according to the present invention, the sole of the club is a sole plate which is made of a corrosion and wear-resistant material of a low coefficient of friction.

In the preferred embodiment of the present invention, a weight member of a nearly circular configuration is integrally formed with a reinforcing member.

As previously pointed out, the club head according to the present invention has many significant advantages over a conventional club head. In particular, the weight ember of a nearly circular configuration works as the reinforcement for the club head to resist the deformation of the club head upon impact with a golf ball, and the impact energy can be efficiently transmitted to the golf ball.

Since the club head, if seen from the top thereof, has a large moment of inertia about the center of gravity, the direction of the club face is less liable to change at the moment of impact of the face against the ball and thus the sweet spot becomes larger.

Furthermore, since the weight member is located near the center of the club head and adjacent to the portion where the ball is hit, stable shots can be obtained. Since the weight member of a nearly circular configuration is provided as mentioned above, the weight of the sole plate can be less than that of a conventional sole plate of a heavy material, and the rotation of the club head can be controlled to resist the backspin of the ball and thus the distance of the flight of the ball is increased.

Furthermore, since the sole plate is made of a corrosion and wear-resistant material, and is a low friction material, the club had can be used for a longer time without getting rusty, and a stable shot can be realized without decreasing the head speed even in duffing because the sole plate is highly slidable.

DESCRIPTION OF THE PREFERRED EMBODIMENTS

Figure 1:
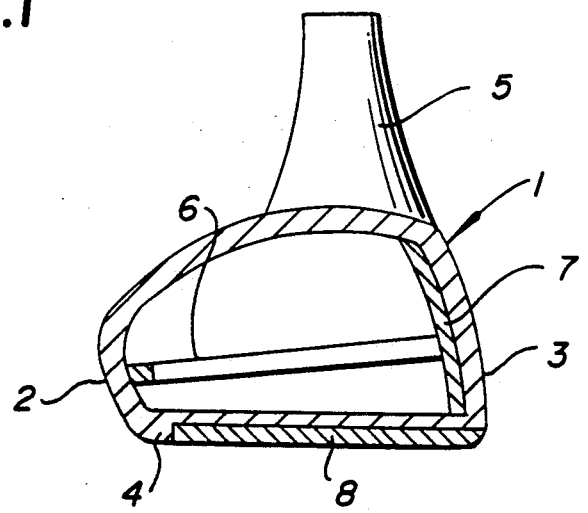
FIG. 1 is a longitudinal sectional view of a golf club head according to a first embodiment of the present invention.

Referring to FIG. 1, a body 1 of a golf club head is made of a fiber-reinforced plastic (FRP) to form a hollow portion therein and comprises a backside 2, a club face 3 located forward of the back side 2, and a sole 4 extending along the underside of the body 1. The body 1 is adapted to receive a shaft (not shown) of the golf club in the hosel 5. THe back side 2 of the body 1 is provided with a weight member 6 of a nearly circular configuration (see FIG. 2), adjacent to the inner circumference of the back side 2.

Figure 2:
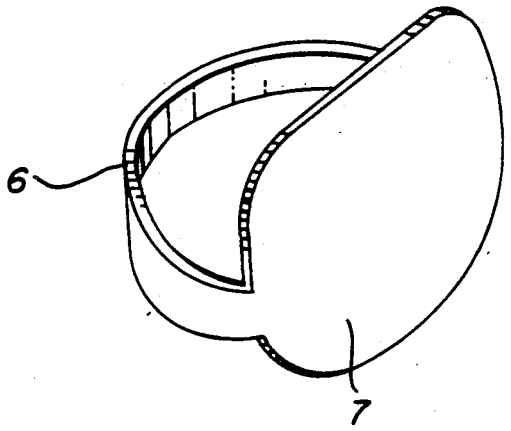
FIG. 2 is a perspective view of a weight member and a reinforcing member of the first embodiment of the club head shown in FIG. 1.

The weight ember 6 is made of metal, such as aluminum or brass, or ceramics and the like, and preferably, the weight member 6 is located at the position lower than the vertical centerline 3*a* of the club face 3. The circular weight member 6 is integrally formed with a reinforcing ember 7 as shown in FIG. 2 which is located on the circumference of the weight member 6. The reinforcing member 7 serves as a reinforcement for the club face 3 and is positioned in contact with the inside of the club face 3. The reinforcing member 67 has almost the same shape as the configuration of the club face 3 and may be made separated from the weight member 6.

A sole plate 8 is fixedly fitted in a recess formed in the sole 4 of the body 1. The sole plate 8 is made of the corrosion and wear-resistant material having low friction, not like the metal material used in conventional golf clubs. Preferably, a polyimide plastic like "Ti-polymer-5032" made by Toray Industries, Inc., or an aromatic polyester plastic like "Ekonor S-300" made by Sumitomo Chemical Co., Ltd. can be used for the sole plate material. This material is superior in corrosion and wear-resistance, and in slide.

In the above-mentioned embodiment, the weight member 6 of a nearly circular configuration, is situated along the inner circumference of the back side 2 of the body 1 and as a result of this circular configuration, the body 1 is protected from deformation upon impact with a golf ball, and the impact energy can therefore be efficiently transmitted on the golf ball. Also, since the weight member is of a circular configuration, the golf club head, if seen from the top thereof, has a large amount of inertia about the center of gravity and hence the sweet spot becomes larger.

Furthermore, since the weight member 6 is situated at a position lower than the vertical centerline 3*a* of the club face 3, the center of gravity of the club head coincides with the center or is slightly lower than the point on the club face where the ball is hit. In comparison with a conventional golf club head where the weight gathers at the sole, the club head according to the present invention has less rotation of the club head and thus the distance of flight of the ball is improved without unnecessary backspin.

Further in this embodiment, the reinforcing member 7 is made of metal or ceramics and is positioned adjacent to the inside of the club face 3. In the golf club head thus constructed, the club face 3 is reinforced by the reinforcing member 7 and does not have to be a thick face as in a conventional club head of FRP. As a result, the reduced weight can be distributed to a position further from the club face resulting in a larger sweet spot and giving better control of the ball.

Since the sole plate is made of corrosion and wear-resistant materials, rust is hardly produced on the sole plate and the club can be used for a longer time. Since the sole plate is also made of a low friction material, it slides easily giving stable shots because head speed is not reduced even when mishitting.

Figure 3:
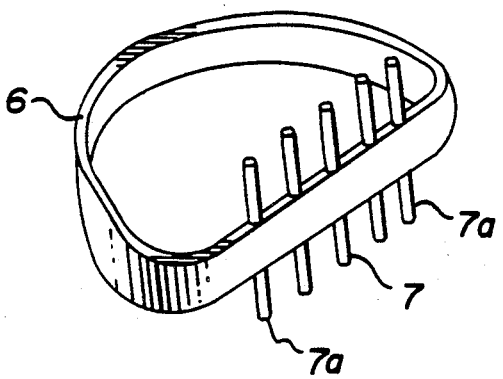
FIG. 3 is a perspective view of a weight member and a reinforcing member according to a second embodiment of the present invention.

FIG. 3 shows a second embodiment of the present invention. In FIG. 3, a reinforcing member 7 is formed by a plurality of vertically extending bar-shaped members 7*a* to reduce the weight thereof, and the bar-shaped reinforcing members 7*a* are integrally formed with a circular weight member 6.

Figure 4:
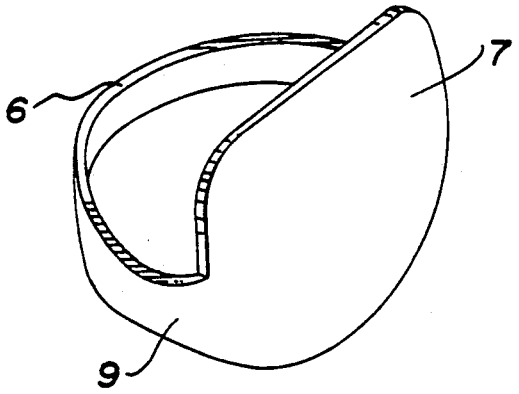
FIG. 4 is a perspective view of a weight member and a reinforcing member according to a third embodiment of the present invention.

FIG. 4 shows a third embodiment of the present invention. In FIG. 4, a circular weight member 6 is formed to add the weight to the side of the club face 3. Namely, there is provided a connecting portion 9 between the circular weight member 6 and the reinforcing member 7, whose width is widened to have more weight at the side of the club face 3. In the golf club head thus constructed, the lower part of the face can be protected from the deformation especially when the ball is hit at the top thereof and thus a low projection ball is rarely produced.

Figure 5:
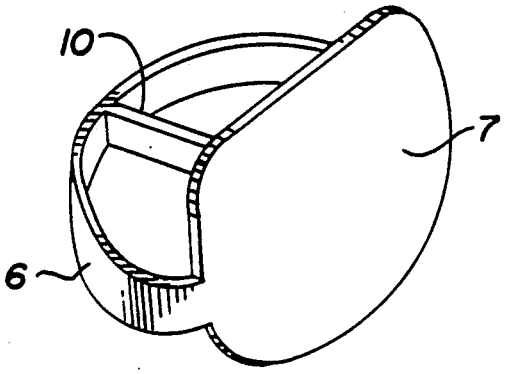
FIG. 5 is a perspective view of a weight member and a reinforcing member according to a fourth embodiment of the present invention.

FIG. 5 shows a fourth embodiment of the present invention. In FIG. 5, a weight member of nearly circular configuration is provided with an additional pillar-like weight member 10 between the circular weight member 6 and the reinforcing member 7 to form a bridge therebetween. This pillar-like weight member 10 is located so that the line connecting the center of gravity and the sweet spot of the club head coincides with the longitudinal axis of the pillar-like weight member 10. In the club head thus constructed, the distance of flight of the ball is increased and the direction of the ball flight is also improved.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A golf club head comprising:

(a) a body made of a fiber-reinforced plastic, said body including a hollow main body and a hosel, said hollow main body including a back side, a club face for hitting a golf ball, a sole, and an inner circumference, defined within said hollow main body said club face having a vertical center;

(b) a weight means having a shape corresponding to said inner circumference at said back side of said hollow main body, wherein a rearmost portion of said weight means contacts said inner circumference at said back side of said hollow main body at a point lower than said vertical center of said club face; and (c) a reinforcing means connected to said weight means and positioned adjacent said inner circumference at said club face of said hollow main body, said weight means and said reinforcing means forming a single band which extends along said inner circumference of said hollow main body.

2. A golf club head according to claim 1, wherein said weight means is integrally connected with said reinforcing means.

3. A golf club head according to claim 1, wherein said sole of said hollow main body includes a sole plate made of a corrosion resistant material.

4. A golf club head according to claim 1, wherein said sole of said hollow main body includes a sole plate made of a wear-resistant, low friction material.

5. A golf club head according to claim 1, wherein said reinforcing means is a plate positioned adjacent said inner circumference at said club face.

6. A golf club head according to claim 5, wherein said weight means is coupled to a vertical center portion of said reinforcing means.

7. A golf club head according to claim 5, wherein said weight means is coupled to a bottom portion of said reinforcing means.

8. A golf club head according to claim 1, wherein said reinforcing means includes a plurality of rods positioned adjacent said inner circumference at said club face.

9. A golf club head according to claim 5, wherein said weight means includes a pillar means extending from said back side to said plate.

* * * * *